US005667112A

United States Patent [19]

Verbruggen

[11] Patent Number: 5,667,112

[45] Date of Patent: Sep. 16, 1997

[54] SELF-STORING SPOUT ASSEMBLY FOR A CONTAINER

[76] Inventor: Anthonius Verbruggen, 545 Sulphur Springs Road, Ancaster, Ontario, Canada, L9H 5E3

[21] Appl. No.: 562,506

[22] Filed: Nov. 24, 1995

[51] Int. Cl.[6] ..... B67D 5/04

[52] U.S. Cl. ..... 222/539

[58] Field of Search ..... 222/538, 539

[56] References Cited

U.S. PATENT DOCUMENTS

| | | | |
|---|---|---|---|
| 3,132,776 | 5/1964 | Wasserberg | 222/539 X |
| 3,181,744 | 5/1965 | Hales | 222/539 |
| 3,454,007 | 7/1969 | Salis | 222/539 X |
| 3,865,270 | 2/1975 | Petersson | 222/539 X |
| 4,265,378 | 5/1981 | Bianco | 222/539 |
| 4,811,965 | 3/1989 | Mueller, Jr. et al. | 222/539 X |

FOREIGN PATENT DOCUMENTS

| | | | |
|---|---|---|---|
| 226142 | 5/1959 | Australia | 222/539 |
| 36 27 238 A1 | 2/1988 | Germany | 222/539 |

*Primary Examiner*—Andres Kishnikow
*Assistant Examiner*—Kenneth Bomberg
*Attorney, Agent, or Firm*—Patrick J. Hofbauer

[57] ABSTRACT

A self-storing spout assembly for use on a container having a threaded neck opening comprises, in combination, an annular cap ring having complimentary internal screw threading, a substantially cylindrical neck insert sized and dimensioned for floating retention within the neck opening, a resilient seal, and a hollow spout member. The neck insert has a central orifice and one or more secondary apertures. The hollow spout has one or more radially directed flow openings therethrough, and is dimensioned to releasably, sealingly engage the cap ring and the central orifice. In the pouring configuration fluid flows from the container, through the secondary apertures in the neck insert, into the hollow spout member via the radially directed flow openings, and exits the hollow spout member through an open pouring end thereof. In a storage configuration, the hollow spout member is inserted into the neck insert in an inverted position, such that fluid enters the hollow spout member as aforementioned and is retained therein by a closed base end of the hollow spout member.

20 Claims, 5 Drawing Sheets

SELF-STORING SPOUT ASSEMBLY FOR A CONTAINER

FIELD OF THE INVENTION

The present invention relates to self-storing and pouring spout assemblies for containers designed to hold volatile liquids, such as gasoline.

BACKGROUND OF THE INVENTION

Storage containers for fluids such as gasoline are frequently provided with spouts to facilitate pouring, with minimal spillage, into the narrowed openings of other vessels which hold volatile fluids, for example, automobile fuel tanks, or the gasoline tanks of small engines such as found in lawn mowers, weed trimmers and small boat motors. It is desirable that the spouts can be removed from the containers after pouring and stored in a manner which will not permit the spouts to become soiled, thus potentially contaminating the fluid during future pours. Such spouts are referred to in this specification and claims as "self-storing". The prior art contains many examples of spouts and container closures in combination. Thus, the concept of using a reversible spout, which can then be stored within the container, typically within the neck of the container, has appeared in many variations in prior patents.

The most commonly used self-storing spout assemblies are those having a spout, a retaining cap ring which threadingly engages the neck of a container, and a separate cover disk which fits over the spout opening in sealing relation with the opening and is operatively secured in place by the retaining ring during storage. In order to pour, the retaining ring and the cover disk must first be removed from the container neck and the spout and retaining cap ring re-assembled on the container neck into the pouring configuration. During this operation, the cover disk is separated from the assembly, and is thereafter frequently misplaced. Moreover, even where the cover disk is not misplaced, if the cover disk is placed on the ground or the like during the pouring operation, it may become contaminated. Thus, the use of self-storing spout and closure assemblies which have discrete cover disks or similar components that are not utilized in both the pouring and storage configurations, can lead to contamination of the contained fluid, and additionally to the frustration of searching for or replacing the misplaced component part. When a misplaced cover disk cannot be found, the assembly will no longer function properly in the storage configuration, and the volatile liquid contained within the container may evaporate. Even more hazardous, is the temptation to the user to continue to store and transport the container without the cover disk in place, or to substitute a rag or other inappropriate item into the neck of the container in place of the cover disk. This practice can have disastrous consequences, particularly where the now improperly sealed container contains gasoline or other highly volatile liquids. Also, where a suitable replacement cover disk cannot be obtained, a new spout-closure assembly must be obtained, if available, or alternatively, the entire container with its attendant spout and closure assembly must be replaced.

Known self-storing spout and closure assemblies have been developed which make use of all component parts in both the pouring and storage configurations. For example, U.S. Pat. No. 3,181,744 uses an adaptor and a dispenser with no loose component parts. Also, U.S. Pat. No. 4,265,378 provides a threaded spout and a threaded bore and achieves sealing through the interaction between a plurality of annular projecting ridges positioned on a sealing member. These devices are rather complex in function and expensive to manufacture. Simpler solutions may be seen in Australian Patent No. 226,142, which relies upon a spout having one closed end which functions as a lid, when in a non-pouring configuration. Sealing of the device is achieved by having a rubber plug positioned upon the closed end of the spout.

Another problem with conventional self-storing spout and closure assemblies is leakage of volatile fluids around the spout or around the container neck during pouring of the fluid. Such leakage is usually due to improper fit between component parts of the assembly caused by poor alignment of the components at their respective points of sealing contact. Additionally, in situations where sealing is achieved by pressing contact between component parts, leaks may occur as a result of the particular materials used to construct the components. If the total area of sealing contact between otherwise somewhat resilient materials is quite large, then the apparent hardness of the contacting portions increases, to the detriment of effective sealing. Accordingly, when pressure is applied, the apparent hardness of the contacting portions of components may increase to a degree that the portions are effectively rigid, and will not deform sufficiently to achieve a good seal.

It is, therefore, an object of the present invention to provide a self-storing spout assembly which will substantially prevent leakage of fluids during pouring.

It is a further object of the present invention to provide a self-storing spout assembly which can self-adjust to ensure a proper alignment of all respective sealing surfaces of the several component parts making up the assembly.

It is yet another an object of the present invention to provide a self-storing spout assembly which does not have any component parts which are not used in both the pouring and the storage configurations of the assembly, so as to prevent loss or contamination of the component parts of the self-storing spout assembly.

SUMMARY OF THE INVENTION

In accordance with the present invention there is disclosed a self-storing spout assembly for use on a container having a threaded neck opening defining a circular rim portion centered about a main axis. The self-storing spout assembly is formed from four component parts in combination. An annular cap ring has a circumferentially depending skirt portion and substantially planar top portion defining a centrally disposed substantially circular portal. The skirt portion has complimentary screw threading on an interior surface thereof to operatively engage the threaded neck opening of the container so as to retain the cap ring over the neck opening with the portal in substantial axial alignment with the main axis. A neck insert means comprises a substantially cylindrical main body portion, a first flange portion projecting radially outwardly from said main body portion adjacent an upper end of said main body portion and a second flange portion projecting radially inwardly from said main body portion adjacent a lower end thereof. The second flange portion defines a central orifice and one or more secondary apertures circumferentially arrayed around the second flange portion external to the central orifice. The first and second flange portions and the main body portion are sized and otherwise dimensioned for floating supported retention of the main body portion within said neck opening of the container with the central aperture in substantially axial alignment with the main axis when the first flange portion is positioned in overlying relation to the circular rim portion.

An annular resilient sealing means is positionable upon the circular rim portion of the neck opening in underlying relation to the first flange portion and is adapted to be compressed into sealing engagement between the circular rim portion and the first flange portion of the neck insert. A hollow spout member has an open pouring end, a closed base end, and a tubular body wall connecting the ends. The body wall has one or more radially directed flow passages positioned between the open pouring end and the closed base end in a region adjacent to the closed base end. The outer surface of the body wall in said region is of cylindrical cross section, and is dimensioned to releasably, sealingly engage both of the portal in said cap ring and the central orifice of the neck insert means when the hollow spout member is inserted into the neck insert means in a pouring configuration (in which the closed base end is positioned within the central orifice and the pouring open end is positioned external to the container), and in a reversed closed configuration (in which closed configuration the closed base end is positioned in sealing relation within the portal and the pouring open end is positioned within the neck opening internal to the container), with the cap ring operatively engaging the threaded neck of the container in overlying and downwardly impinging relation to the first flange portion.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
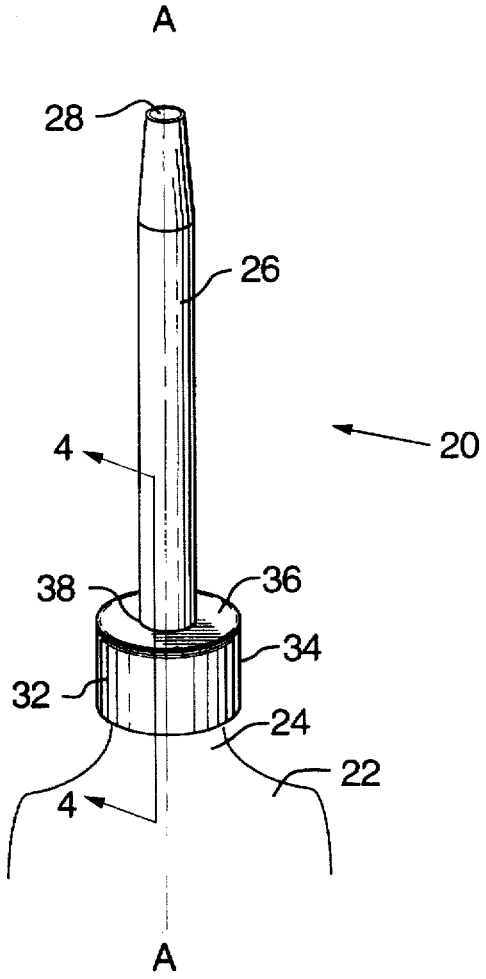
FIG. 1 of the drawings is a top perspective view of a self-storing spout assembly according to a preferred embodiment of the present invention, shown in a pouring configuration, attached to the neck of a container.
Figure 2:
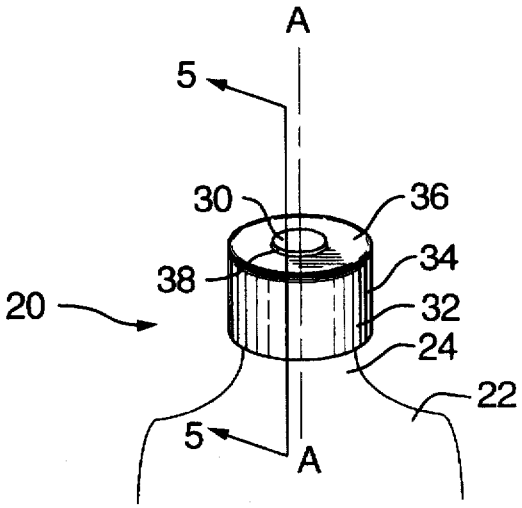
FIG. 2 of the drawings is a top perspective view of the self-storing spout assembly of FIG. 1, shown in a storage configuration, attached to the neck of a container.
Figure 3:
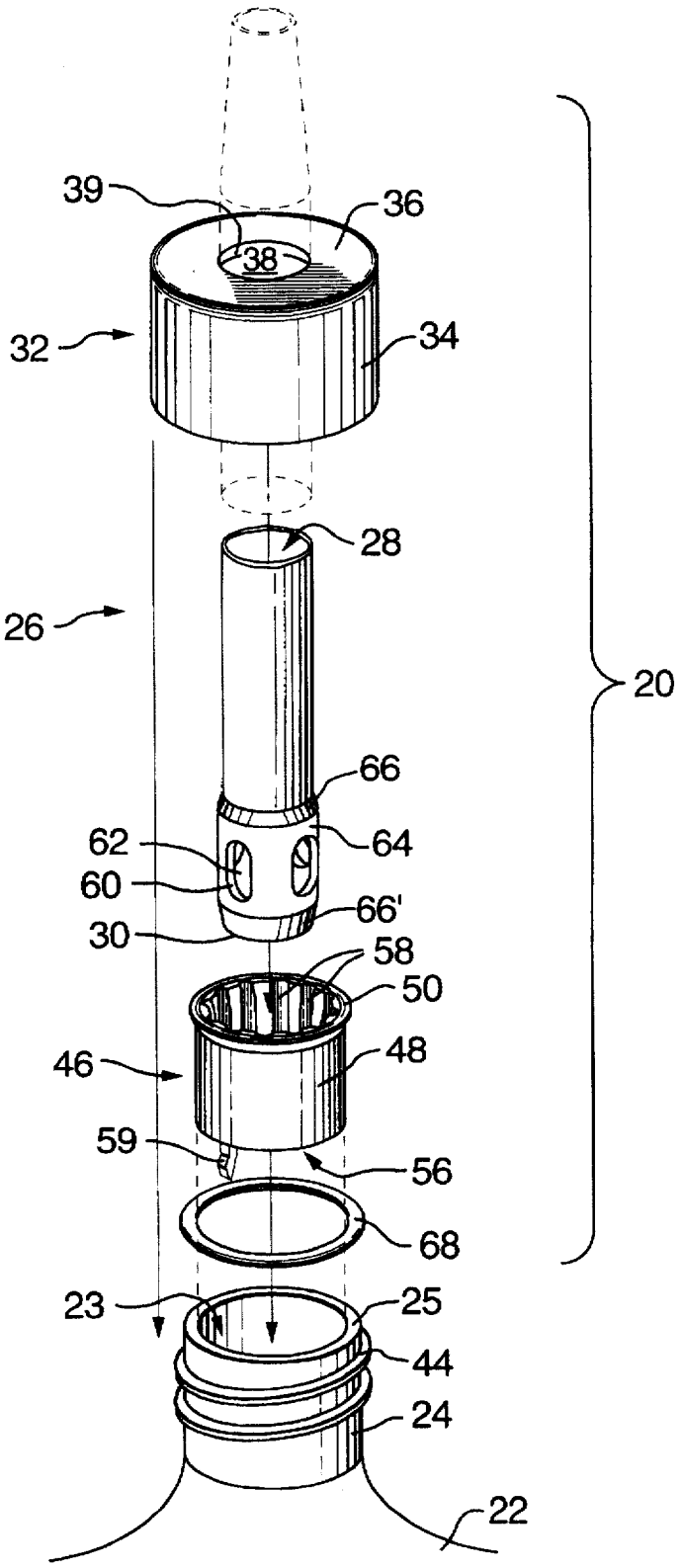
FIG. 3 is an exploded top perspective view of the self-storing spout assembly of FIG. 1, shown positioned above a container having an externally threaded neck opening, additionally showing the positioning, in dotted outline, of the spout member relative to the annular cap ring.

Referring generally to FIGS. 1 and 2 of the drawings, a preferred embodiment of a self-storing spout assembly for use on a container 22 having a threaded neck opening is indicated by reference numeral 20. When the self-storing spout assembly 20 is assembled and fixed to a container 22, a main vertical axis is defined (identified as Line A—A in FIGS. 1 and 2), which axis A—A passes through the centre of a central aperture within a conventionally externally screw-threaded neck 24 of the container 22. The assembly is reversible, in that a hollow spout member 26 can either be positioned, as shown in FIG. 1, atop the neck 24 of the container 22, with an open pouring end 28 of the spout member 26, tapering slightly and projecting upwardly from the container neck 24 to facilitate pouring (hereinafter, the "pouring configuration"), or the hollow spout member 26 can be positioned, as shown in FIG. 2, within the neck opening 24 of the container 22, with the open pouring end 28 of the spout member projecting downwardly within the container 22, and a closed base end 30 of the spout member 26 directed upwardly from the container 22 for sealed storage of the fluid (not shown) held in the container 22 (hereinafter, the "storage configuration"). In both of the configurations, the spout member 26 is secured to neck 24 of the container 22 by means of an annular cap ring 32, which annular cap ring 32 is positioned in overlyingly securing contact with the neck 24 of the container 22.

Referring in greater detail now to FIGS. 3, 4, 5 and 8, the annular cap ring 32 has a circumferentially depending skirt portion 34 and a substantially planar top portion 36. An inner surface 40 of skirt portion 34 is contoured with internal screw threading 42, which threading is complementary to external screw threading 44 on the neck 24 of container 22. The particular size and gauge of the internal screw threading 42 can be routinely selected to conform to the neck opening size and to the external screw threading 44 of conventional containers. A cylindrical recess 35 (best seen in FIG. 8), is positioned on the inner surface 40 at the upper edge of the skirt portion 34 of the annular ring cap 32. The inner surface 40 of the skirt portion 34 tapers outwardly, downwardly from the lower edge of the cylindrical recess 35, thus forming an outwardly, downwardly projecting substantially conical tapered surface 37 contiguous with the cylindrical recess 35. The planar top portion 36 has a substantially circular portal 38 centered therein. A rim 39 is upwardly, inwardly substantially conically tapered, and said rim 39 defines the boundaries of the portal 38. The portal 38 is substantially co-axial with the main vertical axis A—A, when the annular cap ring 32 is threadingly engaged with the neck 24 of the container 22.

A neck insert means 46 has a substantially cylindrical main body portion 48, which main body portion flares outwardly, adjacent its upper end to form a radially projecting first flange portion 50. The first flange portion 50 is preferably provided with an inwardly, downwardly substantially conically tapered undersurface 51. The neck insert means 46 is sized and dimensioned substantially for floating retention within the central aperture of the container neck 24. Floating retention refers to the fact that the cylindrical main body portion 48 may be sufficiently smaller than the container neck 24, such that the main body portion 48 does not necessarily physically contact the entire inner surface of the container neck 24. Instead, the neck insert means 46 is retained in position within the container neck 24 by the first flange portion 50, which first flange portion 50 is sized and positioned to overlie a circular rim portion 25 of the neck 24 of the container 22. When the annular cap ring 32 is screw threadingly tightened to the neck 24 of the container, the first flange portion 50 will slide along the outwardly, downwardly projecting substantially conically tapered surface 37 and will automatically centre and seat itself within the cylindrical recess 35 of the annular cap ring, thus ensuring proper axial alignment of the neck insert means 46 with respect to the annular cap ring 32.

Figure 6:
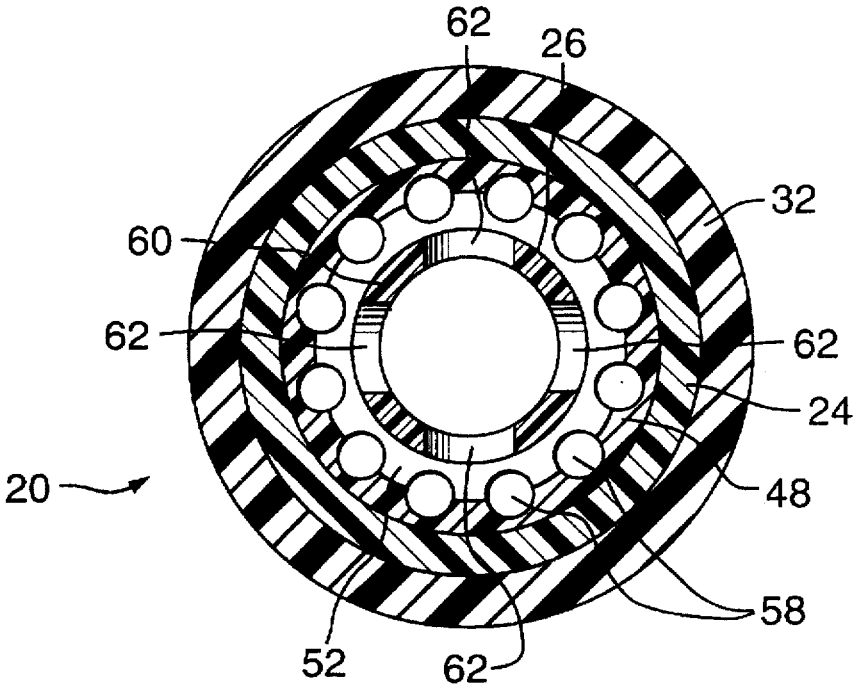
FIG. 6 of the drawings is a cross-sectional view of the assembly of FIG. 4 along sight line 6—6 of FIG. 4.
Figure 7:
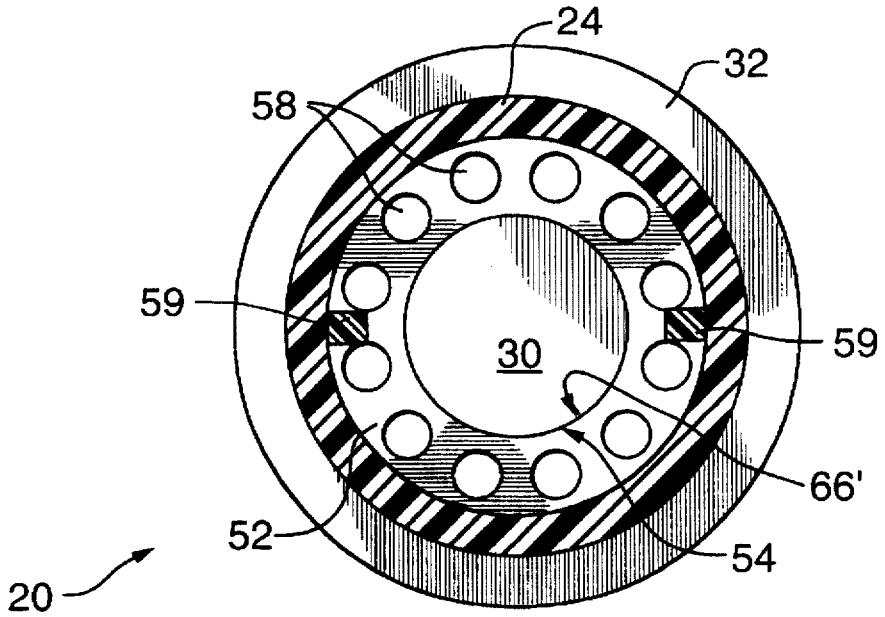
FIG. 7 of the drawings is a cross-sectional view of the assembly of FIG. 4 along sight line 7—7 of FIG. 4; and, FIG. 8 of the drawings is an exploded longitudinal sectional view of the assembly of FIG. 3.
Figure 8:
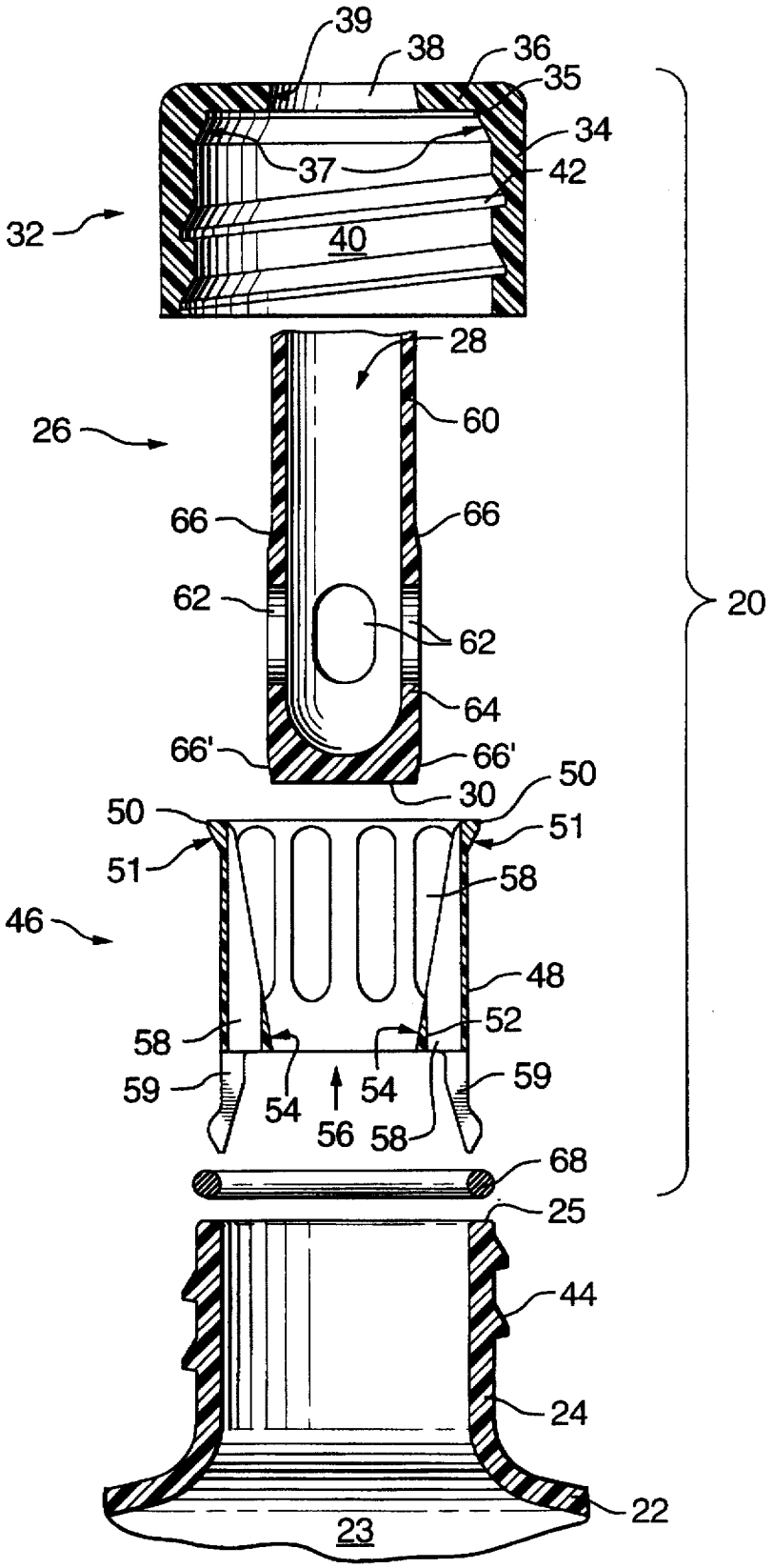

A second flange portion 52 projects radially inwardly from the main body portion 48. The second flange portion 52 forms a base of the neck insert means 46, and the second flange portion 52 has a central internal rim 54 which tapers inwardly, downwardly, narrowing in a substantially conical manner to define at its lower end, a central orifice 56. Additionally, one or more secondary apertures 58 are circumferentially arrayed around the central orifice 56. The secondary apertures 58 may take the form of simple holes through the base formed by the second flange portion 52, or as illustrated in the preferred embodiment and best seen in FIGS. 4, 5, and 8 herein, the secondary apertures may take the form of axially elongate fluid flow channels which travel upwardly through the conical narrowing of the internal tapered rim 54 to emerge within the neck insert means 46 at positions below the first flange portion 50. The number and positioning of the secondary apertures 58 may be varied somewhat, but according to the preferred embodiment illustrated, an optimal number of twelve secondary apertures 58 is used, and the secondary apertures 58 are positioned equidistant one another. The number and position of the secondary apertures 58 are best seen in FIGS. 6 and 7. The secondary apertures 58 direct the liquid to be poured from the interior 23 of the container 22 toward the spout member 26.

Figure 4:
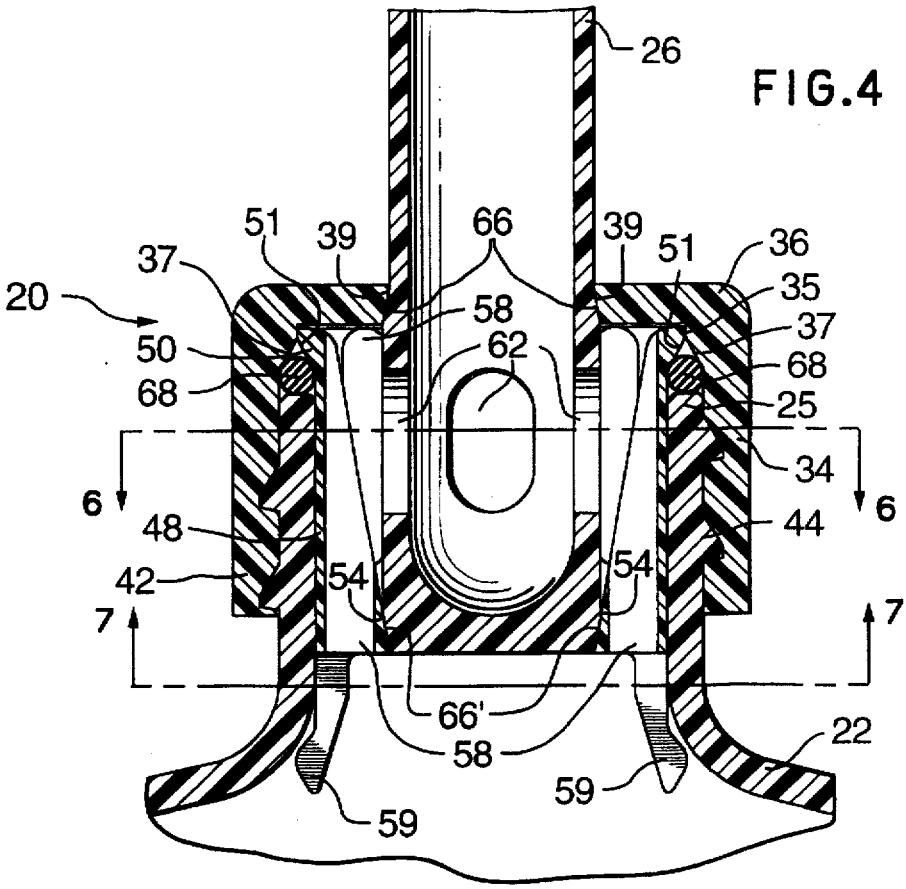
FIG. 4 of the drawings is an elevational sectional view of the assembly of FIG. 1 along sight line 4—4 of FIG. 1, showing the assembly in the pouring configuration.
Figure 5:
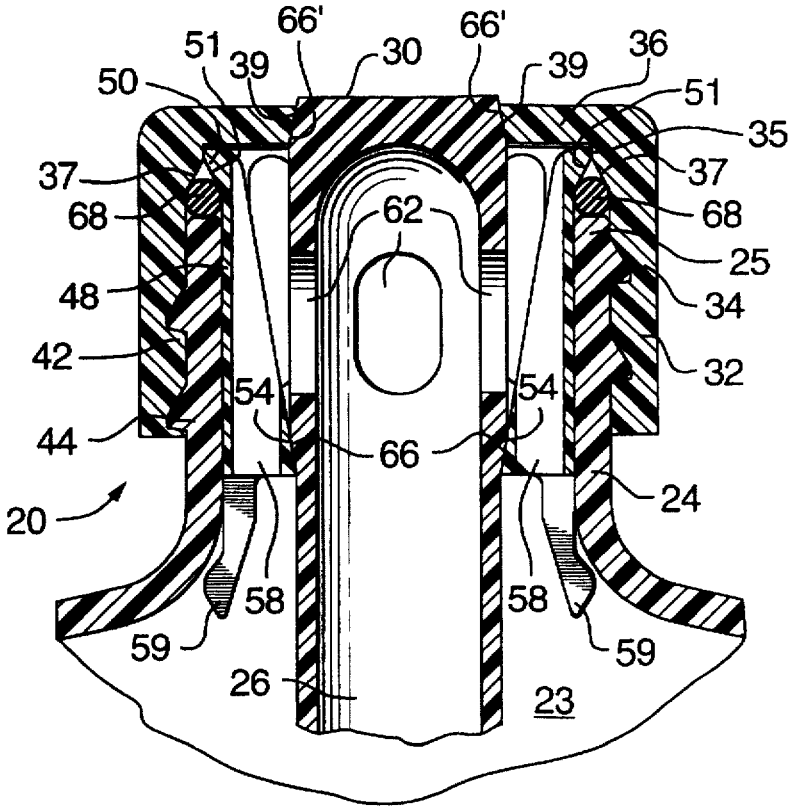
FIG. 5 of the drawings is an elevational sectional view of the assembly of FIG. 2 along sight line 5—5 of FIG. 2, showing the assembly in the storage configuration.

The neck insert means 46 is additionally provided with at least two retaining lugs 59, which retaining lugs 59 project downwardly, outwardly from the underside of the second flange portion 52, as best seen in FIGS. 4, 5, and 7. The retaining lugs 59 ensure that, once the neck insert means 46 has been installed into the container 22, the neck insert means 46 will not accidentally fall out of the container neck 24, and further, will not be readily pulled out of the container neck 24 when the spout member 26 is lifted out of the neck insert means 46, to convert the self-storing spout assembly 20 from the storage configuration to the pouring configuration or vice versa (see FIGS. 4, 5, and 7).

The spout member 26 is hollow, having a tubular body wall 60 connecting the open pouring end 28 to the closed base end 30. One or more radially directed flow passages 62 are positioned in the tubular body wall 60 between the open pouring end 28 and the closed base end 30. The number and positioning of the radially directed flow passages 62 can be varied; however, the function of the device will be optimized where a plurality of flow passages are used, and where such passages are located equidistant one another around the circumference of the hollow spout member 26. This positioning permits free fluid flow from the secondary apertures 58 of the second flange portion 52 to the radially directed flow passages 62, regardless of the relative rotational positioning of the neck insert means 46 and the hollow spout member 26. Additionally, the flow rate through the self-storing spout assembly 20 is optimized when the ratio of the total cross sectional area of the secondary apertures 58 to the total cross sectional area of the radially directed flow passages 62 is approximately 1:1; thus neither of these structures would singularly limit the flow rate of the fluid being poured. The preferred arrangement, being twelve (12) circumferentially aligned secondary apertures 58 with four (4) circumferentially aligned radially directed flow passages 26, is best seen in FIG. 6.

The outer surface of the tubular body wall 60 of the spout member 26 preferably has a contoured region 64 positioned between the open pouring end 28 and the closed base end 30, adjacent to the closed base end 30, which contoured region 64 is of enlarged cylindrical cross section and is dimensioned at its ends to releasably, sealingly engage the tapered rim 39 of the portal 38 in the annular ring cap 32, and the tapered rim 54 of the central orifice 56 in the neck insert means 46. In the preferred embodiment illustrated, the contoured region 64 is of a greater outside diameter than the remainder of the tubular body wall 60. A substantially congruent conical taper 66, 66' is provided at each opposed end of the contoured region 64. The conical taper 66 is nearest the open pouring end 28, while the conical taper 66' is nearest the closed base end 30. Each of the tapers 66, 66' narrow toward their respective end of the spout member 26. The angle of the conical tapers 66 and 66' are not only congruent with one another, but are also complementary to the angles of the tapered rim 39 of the portal 38 and the tapered rim 54 of the central orifice 56. Thus, each conical taper 66, 66' is adapted to sealingly engage either the tapered rim 39 of the portal 38 or the tapered rim 54 of the central orifice 56, depending upon whether the spout member 26 is positioned in the pouring configuration or the storage configuration.

The provision of the conical tapers 66, 66' on the ends of the contoured region 64 provide a number of advantages. The screw threading engagement of the annular cap ring 32 to the externally threaded container neck 24 creates impinging pressure upon the various components of the self-storing spout assembly 20 to create a fluid tight seal in both the pouring configuration and the storage configuration. The conical tapers 66, 66' facilitate the axial alignment of the spout member 26 within the neck insert means 46 when the annular cap ring 32 is removed and the spout member 26 is reversed in vertical orientation to convert the self-storing spout assembly 20 from the pouring configuration to the storage configuration or vice versa. This, in turn, ensures self-correcting sealing alignment of the several parts of the self-storing spout assembly. That is, the particular conical taper 66 or 66' which engages the tapered rim 54 of the central orifice 56 of the neck insert means 46 will correctly seat itself therein, upon insertion into the neck insert means 46. Further, when the annular cap ring 32 is positioned onto the container neck 24, the tapered rim 39 of the portal 38 will contact the respective conical tapering 66 or 66' in complementary relation. The effect of the contact of the complementary conical tapering is to provide an automatic axial alignment of the spout member 26 within the annular cap ring 32. The third advantage of the conical taper 66, 66' relates to the effectiveness of conical geometry as used in sealing components. Sealing components which are manufactured with conical sealing surfaces ordinarily produce effective seals since any slippage or creep between the components acts, because of the complementary shaping of two conical components, to move the two components more closely together, thus increasing rather than decreasing sealing characteristics. The conical tapers 66, 66' and the complementary tapered rims 39 and 54 on the portal 38 and the central orifice 56 respectively, employ this principle to create highly effective fluid seals between the spout member 26, the annular cap ring 32 and the neck insert means 46 in both the pouring and storage configurations.

A supplementary sealing means is also required between the annular cap ring 32, the container neck 24, and the first flange portion 50 of the neck insert means 46. The juncture of these structures facilitates the floating support of the neck insert means 46 within the container neck 24. As previously mentioned, the neck insert means 46 is sized and dimensioned substantially for floating retention within the central aperture of the container neck 24. The floating retention of the neck insert means 46 is advantageous in that the potential for leaks, which arises when one attempts to create a tight sealing fit between components in contact with one another, is avoided. As the contact area between separate components increases, the apparent hardness of the materials increases proportionally, such that the ability of the components to sealingly interact is decreased. In the present invention, no attempt is made to create a sealing fit between the entire substantially cylindrical surface of the main body portion 48 of the neck insert means the the central aperture of the container neck 24. Instead, in order to ensure a fluid tight seal between the neck insert means 46 and the container 22, an annular resilient sealing means 68 is positioned upon the circular rim portion 25 of the container neck 24 in underlying relation to the first flange portion 50 of the neck insert means 46. The annular resilient sealing means 68 should be constructed from a resilient material, such as synthetic rubber. A soft neoprene rubber "O-ring" type gasket is preferred, though other forms and materials for construction of the resilient sealing means 68 could be employed. The material of choice must, of course be chemically inert when in contact with the intended fluids to be stored in the container 22. When the spout means 26 is inserted into the neck insert means 46, (as discussed above) and the annular cap ring 32 is screw threadingly tightened to the container neck 24, downward pressure is placed upon the first flange portion 50 through the impinging action of the underside of the planar top portion 36 of the annular cap ring 32 upon the first flange portion 50. Moreover, such tightening of the annular cap ring 32 causes the inwardly, downwardly substantially conically tapered undersurface 51 of the first flange portion 50 to transmit downward, outward pressure to the annular resilient sealing means 68 and the downwardly, outwardly substantially conically tapered surface 37 of the skirt portion 34 to transmit downward, inward pressure to the annular resilient sealing means 68. Thus, the annular resilient sealing means 68 is, by the action of the conically tapered undersurface 51 and the conically tapered surface 37, thereby opposingly, trappingly engaged and compressed against the underlying circular rim portion 25 of the container neck 24. This arrangement ensures that a liquid tight seal is established between the annular cap ring 32, the neck insert means 46, and the circular rim portion 25 of the container neck 24.

This arrangement is advantageous for a number of reasons. As discussed above, the floating retention of the neck insert means 46, combined with the use of the annular resilient sealing means 68, eliminates the potential for leakage between tightly fitting structures. Further, as it is not necessary to ensure a tight fit between the cylindrical main body portion 48 of the neck insert means 46 and the container neck 24, the manufacturing tolerances for container necks need not be stringent. The self-seating of the first flange portion 50 of neck insert means 46 within the cylindrical recess 35 of the annular cap ring 32, and the sealing interaction between the conically tapered surface 37, the tapered undersurface 51, the annular resilient sealing means 68, and the circular rim 25 of the neck 24 creates an assembly which is largely independent of the manufacturing tolerances of the container neck. Furthermore, the interaction of the conical tapers 66, 66' of the hollow spout member 26 with the complementary tapers of each of the tapered rim 54 of neck insert 46 and the tapered rim 39 of the annular cap ring 32 ensures the automatic axial alignment of the hollow spout member 26 within the neck insert means 46 and the annular cap ring 32. Accordingly, due to the precise tolerances and fit of its various component parts, the self-storing spout assembly of the present invention will function effectively despite variability in the size of the container necks with which it may be used. This is especially important with blow-molded containers, such as portable gasoline containers, where manufacturing tolerances are liberal. Accordingly, it is possible to effectively retro-fit the assembly of the present invention for operation with pre-existing containers, since within a given standard size, it is possible to compensate for significant variations in the internal neck diameter of a particular container whilst maintaining adequate sealing of the assembly and operative axial alignment of the several components of the assembly. Overall cost effectiveness can be achieved, both in terms of the saving realized when the assembly of the present invention is retro-fit to pre-existing containers as a replacement part, and when the assembly of the present invention is manufactured for use with new inexpensively blow-molded containers.

The self-storing spout operates by means of a curved fluid flow path. In the pouring configuration as seen in FIG. 4, the interior of the container 22 is in fluid communication with the exterior of the container through the hollow spout member 26 by means of the establishment of fluid communication between the radially directed flow passages 62 of the spout member 26, and the secondary apertures 58 in the second flange portion 52 of the neck insert means 46. Fluid then flows down the length of the hollow spout member 26 and exits the spout member 26 through the open pouring end 28 thereof. In the storage configuration, the spout member 26 is positioned in the neck insert means with the open pouring end 28 directed downwardly through the neck insert means 46 so as to protrude into the interior 23 of the container 22 through the central orifice 56. The closed base end 30 of the spout member 26 is, in this configuration, directed upwardly from the container 22, and is positioned in the portal 38 of the annular cap ring 32, with the contoured region 66' in sealing contact with the tapered rim 39. As shown in FIG. 5, there is no fluid communication between the interior of the container 22 and the exterior of the container in the storage configuration. Fluid can travel through the secondary apertures 58 in the second flange portion 52 of the neck insert means 46, and can pass into the spout member 26 through the flow passages 62 therein; notwithstanding this, the fluid remains retained within the container 22 by the closed base end 30 of the spout member 26. Additionally, due to the fluid tight seal between the annular cap ring 32, the circular rim portion 25, and the first flange portion 50 of the neck insert means 46, as facilitated by the annular resilient sealing means 68, leakage of fluid from the container is prevented.

The annular cap ring 32, the neck insert means 46 and the spout member 26 are preferably constructed from the same, or different, slightly resilient plastics material. A small measure of resilience is preferable in the construction of these components in order to improve the pressure sealing contact between the conical taper 66, 66', the tapered rim 39 of portal 38 of the annular retaining cap 32, and the tapered rim 54 of the central orifice 56 of the neck insert means 46. These components should also be constructed from a material which will resist decomposition from contact with volatile fluids such as gasoline, kerosene, etc.. Various conventional plastic materials are available from which to construct the components. Synthetic polymer plastic materials, such as polyethylene or polypropylene, are preferred. Component parts can be cost effectively precision injection molded from these plastics to construct the components of the self-storing spout assembly 20 of the present invention.

In the preferred embodiment described and illustrated above, the self-storing spout assembly 20 of the present invention is optimally designed for use with most containers for volatile fluids. It will be obvious to those skilled in the art that the invention could be used effectively in a wide range of fluid container applications beyond the storage and pouring of volatile liquids such as gasoline. For example, the device could be used for containers in which comestibles such as milk or soft drinks are stored. Additionally, the self-storing spout assembly 20 could be adapted for use with containers for other substances, such as household cleaning liquids. Thus, it will be apparent that the scope of the present invention is limited only by the claims set out hereinbelow.

I claim:

1. A self-storing spout assembly for use on a container having a threaded neck opening defining a circular rim portion centered about a main axis, the spout assembly comprising, in combination:

an annular cap ring having a circumferentially depending skirt portion and a substantially planar top portion defining a centrally disposed substantially circular portal, said skirt portion having complimentary screw threading on an interior surface thereof to operatively engage the threaded neck opening of said container to retain said cap ring over said neck opening with said portal in substantial axial alignment with said main axis;

a neck insert means comprising a substantially cylindrical main body portion, a first flange portion projecting radially outwardly from said main body portion adjacent an upper end of said main body portion and a second flange portion projecting radially inwardly from said main body portion adjacent a lower end thereof, said second flange portion defining a central orifice and one or more secondary apertures circumferentially arrayed around said second flange portion external to said central orifice, said first and second flange portions and said main body portion being sized and otherwise dimensioned for floating supported retention of said main body portion within said neck opening of said container with said central aperture in substantially axial alignment with said main axis when said first flange portion is positioned in overlying relation to said circular rim portion;

an annular resilient sealing means positionable upon the circular rim portion of the neck opening in underlying relation to said first flange portion and adapted to be compressed into sealing engagement between said circular rim portion and said first flange portion of said neck insert means when in said underlying relation;

a hollow spout member having an open pouring end, a closed base end, and a tubular body wall connecting said ends, said body wall having one or more radially directed flow passages positioned between said open pouring end and said closed base end in a region adjacent to said closed base end, an outer surface of said body wall in said region being of cylindrical cross section and being dimensioned to releasably, sealingly engage both of said portal in said cap ring and said central orifice of said neck insert means when said hollow spout member is inserted into said neck insert means in a pouring configuration in which said closed base end is positioned within said central orifice and said pouring open end is positioned external to said container with said cap ring operatively overlying and impinging in a downward direction upon said first flange portion, and when said hollow spout member is inserted into said neck insert means in a reversed closed configuration, in which closed configuration said closed base end is positioned in sealing relation within said portal and said pouring open end is positioned within the neck opening internal to said container with said cap ring operatively engaging the threaded neck of the container in overlying and downwardly impinging relation to said first flange portion.

2. The self-storing spout assembly of claim 1, wherein the second flange portion of said neck insert means tapers inwardly, downwardly in a substantially conical manner.

3. The self-storing spout assembly of claim 2, wherein said substantially circular portal of said annular cap ring tapers inwardly, upwardly in a substantially conical manner.

4. The self-storing spout assembly of claim 3, wherein the outer surface of said tubular body wall of said spout member when in the pouring configuration tapers inwardly, downwardly, adjacent the closed end of said spout member to form a sealing contact surface, which surface is adapted to releasably, sealingly engage the second flange portion of said neck insert means when in said pouring configuration, and to releasably, sealingly engage the substantially circular portal of said annular cap ring when in said reversed closed configuration.

5. The self-storing spout assembly of claim 4, wherein the outer surface of said tubular body wall of said spout member when in the pouring configuration tapers outwardly, downwardly, above the level of said flow passages to form a sealing contact surface, which surface is adapted to releasably, sealingly engage the second flange portion of said neck insert means when in said reversed closed configuration, and to releasably, sealingly engage the substantially circular portal of said annular cap ring when in said pouring configuration.

6. The self-storing spout assembly of claim 1, further comprising at least two retaining lugs projecting downwardly from the second flange portion of said neck insert means, said lugs being adapted for retaining contact with the inside wall of said container.

7. The self-storing spout assembly of claim 1, wherein the annular cap ring, neck insert means and hollow spout member are constructed of a resilient plastics material.

8. The self-storing spout assembly of claim 7, wherein the plastics material is polyethylene.

9. The self-storing spout assembly of claim 7, wherein the plastics material is polypropylene.

10. The self-storing spout assembly of claim 1, wherein the annular resilient sealing means is an "O" ring.

11. The self-storing spout assembly of claim 10, wherein the annular resilient sealing means is constructed from a flexible material which is resistant to degradation by gasoline.

12. The self-storing spout assembly of claim 11, wherein said sealing means is constructed from a resilient rubber material.

13. The self-storing spout assembly of claim 12, wherein the resilient rubber material is neoprene rubber.

14. The self-storing spout assembly of claim 1, wherein the hollow spout member is tapered at its open pouring end.

15. The self-storing spout assembly of claim 1, wherein the number of secondary apertures circumferentially arrayed around said second flange portion is 12.

16. The self-storing spout assembly of claim 1, wherein the number of radially directed flow passages in said hollow spout member is 4.

17. The self-storing spout assembly of claim 1, wherein the ratio of the total cross sectional area of the secondary apertures to the total cross sectional area of the of radially directed flow passages is approximately 1:1.

18. The self-storing spout assembly of claim 1, wherein the annular cap ring is contoured for axially aligned self-seating of the first flange portion therein.

19. The self-storing spout assembly of claim 18, wherein the annular cap ring is contoured for said axially aligned self-seating of the first flange portion therein by means of a cylindrical recess positioned on the inner surface of said skirt portion of said annular cap ring adjacent the planar top portion of said annular cap ring, and by means of an outwardly, downwardly projecting substantially conically tapered surface contiguous with said cylindrical recess, which substantially conical tapered surface directs said first flange portion into said cylindrical recess upon screw tightening of said annular cap ring.

20. The self-storing spout assembly of claim 19, wherein said first flange portion is provided with an inwardly, downwardly substantially conically tapered undersurface, and wherein the outwardly, downwardly substantially conically tapered surface of said skirt portion and the inwardly, downwardly substantially conically tapered undersurface of the first flanged portion are each adapted to opposingly, trappingly compress said annular resilient sealing means in operative sealing relation against said circular rim portion of the container neck upon screw tightening of said annular cap ring.

* * * * *